United States Patent [19]

Ozaki et al.

[11] 4,149,503

[45] Apr. 17, 1979

[54] EXHAUST GAS RECIRCULATION SYSTEM FOR AN INTERNAL COMBUSTION ENGINE

[75] Inventors: Tadashi Ozaki; Tokio Kohama, both of Nishio; Hideki Obayashi, Aichi, all of Japan

[73] Assignee: Nippon Soken, Inc., Nishio, Japan

[21] Appl. No.: 838,223

[22] Filed: Sep. 30, 1977

Related U.S. Application Data

[63] Continuation-in-part of Ser. No. 756,702, Jan. 4, 1977, Pat. No. 4,100,734.

[30] Foreign Application Priority Data

Oct. 1, 1976 [JP] Japan ..... 51-118738
Oct. 1, 1976 [JP] Japan ..... 51-118739

[51] Int. Cl.[2] ..... F02M 25/06
[52] U.S. Cl. ..... 123/119 A
[58] Field of Search ..... 123/119 A

[56] References Cited

U.S. PATENT DOCUMENTS

| | | | |
|---|---|---|---|
| Re. 27,993 | 4/1974 | Walker | 123/119 A |
| 2,543,194 | 2/1951 | Paris, Jr. | 123/119 A |
| 3,237,615 | 3/1966 | Daigh | 123/119 A |
| 3,802,402 | 4/1974 | Swatman | 123/119 A |
| 3,844,261 | 10/1974 | Garcea | 123/119 A |
| 3,882,837 | 5/1975 | Horie et al. | 123/119 A |
| 3,983,854 | 10/1976 | August | 123/119 A |

*Primary Examiner*—Wendell E. Burns
*Attorney, Agent, or Firm*—Cushman, Darby & Cushman

[57] ABSTRACT

An engine exhaust gas recirculation system has an E.G.R. passage extending from an exhaust system of the engine to an intake system thereof downstream of an engine throttle valve. First and second E.G.R. control valves are provided at first and second points in the E.G.R. passage to control the exhaust gas-flow cross-sectional area of the E.G.R. passage at the first and second points, respectively. The first E.G.R. control valve is operatively connected to the throttle valve and disposed downstream of the second E.G.R. control valve. The intake air pressure upstream of the throttle valve is compared with the exhaust gas pressure between the first and second E.G.R. control valves to control the second E.G.R. control valve such that the exhaust gas pressure in the E.G.R. passage between the first and second E.G.R. control valves is made substantially equal to the air pressure in the engine intake system between the throttle valve and a venturi of a carburetor.

10 Claims, 6 Drawing Figures

EXHAUST GAS RECIRCULATION SYSTEM FOR AN INTERNAL COMBUSTION ENGINE

CROSS REFERENCE TO RELATED APPLICATION

This application is a continuation in part of our earlier copending application Ser. No. 756,702 U.S. Pat. No. 4,100,734 Jan. 4, 1977.

BACKGROUND OF THE INVENTION

1. Field of the Invention

The present invention relates to an engine exhaust gas recirculation system effective to reduce the emission of nitrogen oxides ($NO_x$).

2. Description of the Prior Art

The prior art engine exhaust gas recirculation systems (hereunder termed "E.G.R. system") conventionally used to reduce $NO_x$ emission are classified into plate type and manifold type. The E.G.R. system of the plate type includes an E.G.R. passage extending from an exhaust pipe of an engine to an intake pipe upstream of a throttle valve. A fixed orifice is provided in the E.G.R. passage. The E.G.R. system of the manifold type has an E.G.R. passage extending from the exhaust pipe to the intake pipe downstream of the throttle valve. A valve is provided in the E.G.R. passage to control the recirculation of engine exhaust gases back into the intake pipe.

In the first or plate type E.G.R. system, because engine exhaust gases flow back into the intake pipe upstream of the throttle valve, the engine back pressure, which is a function of the amount of engine intake air, is solely the function of the amount of exhaust gas recirculation. The amount of the recirculated exhaust gases is thus advantageously proportional to the amount of the engine intake air. The E.G.R. system of this type, however, has disadvantageous problems that a deposit of a foreign material is formed on the throttle valve, an advance port is blocked, the carburetor and related components of the engine suffer from thermal influence, parts made of aluminum or aluminum alloys are corroded and icing occurs at a low temperature.

In the E.G.R. system of the second or manifold type, the above disadvantageous problems hardly occur because the exhaust gases are recirculated directly into the engine intake manifold downstream of the throttle valve. In the second type of E.G.R. system, however, the recirculation of exhaust gases is influenced by the engine intake manifold vacuum and thus is increased and decreased in light and heavy operating conditions of engine, respectively. Thus, valve means are required for this type of E.G.R. system to control the recirculation of exhaust gases such that the exhaust gas recirculation is not influenced by the engine intake manifold vacuum. In a conventional E.G.R. system, the E.G.R. control valve is simply controlled by the intake manifold vacuum such that the valve is closed to interrupt the recirculation of the exhaust gases at an engine operating condition where the exhaust gas recirculation is undesirable to the engine operation. The intake manifold vacuum is formed into ON and OFF signals depending upon the positions of the throttle valve. In another conventional E.G.R. system, either intake manifold vacuum or venturi vacuum is used to control the E.G.R. control valve so that the valve opening is decreased at light load engine operating condition to prevent the exhaust gas recirculation from being influenced by the intake manifold vacuum and so that the valve opening is increased to increase the exhaust gas recirculation at heavy load engine operating condition. In any case, however, the influence of the intake vacuum on the exhaust gas recirculation could not completely be eliminated to such an extent where the exhaust gas recirculation was made proportional to the engine intake air. In the prior art E.G.R. system, therefore, the exhaust gas recirculation was unduely increased relative to the intake air flow at a light load engine operating condition with resultant occurence of surging and misfires, whereas the exhaust gas recirculation was decreased relative to the intake air flow at a heavy load engine operating condition with resultant decrease in the reduction of $NO_x$ emission. With the prior art E.G.R. system, therefore, it has been difficult to reduce $NO_x$ emission without adverse affect on the engine operation.

In applicants' earlier copending application Ser. No. 756,702 referred to above, a manifold type exhaust gas recirculation system is disclosed which comprises an E.G.R. passage for the recirculation of engine exhaust gases from an exhaust system of an engine back into an intake system thereof downstream of an engine throttle valve. A first E.G.R. control valve is provided at a first point in the E.G.R. passage and operatively connected to the throttle valve to control E.G.R. flow through the E.G.R. passage at the first point. A second E.G.R. control valve is provided at a second point in the E.G.R. passage upstream of the first E.G.R. control valve to control E.G.R. flow through the E.G.R. passage at the second point toward the first point. A valve controller is provided for the second E.G.R. control valve and operative in response to the variation in the exhaust gas pressure in the E.G.R. passage between the first and second E.G.R. control valves to control the second E.G.R. control valve so that the exhaust gas pressure between the first and second E.G.R. control valves is maintained substantially constant.

SUMMARY OF THE INVENTION

It is an object of the present invention to provide a novel, improved and inexpensive manifold type exhaust gas recirculation system.

The exhaust gas recirculation system according to the present invention comprises an E.G.R. passage for recirculating engine exhaust gases from an exhaust system of an engine back into an intake system thereof downstream of a throttle valve of the engine. First and second E.G.R. control valves are disposed at first and second points in the E.G.R. passage to control the exhaust gas-flow cross-sectional area of the E.G.R. passage at the first and second points, respectively. The first E.G.R. passage is disposed downstream of the second E.G.R. passage and operatively associated with the engine throttle valve. Means are provided for controlling the second E.G.R. control valve so that the exhaust gas pressure in the E.G.R. passage between the first and second E.G.R. control valves is made substantially equal to the air pressure in the engine intake system between the throttle valve and a venturi of a carburetor of the engine.

The first E.G.R. control valve and the E.G.R. passage adjacent to the first point may preferably be arranged such that, at a throttle part-open engine operating condition, an opening area ratio of the E.G.R. passage, that is the ratio of the exhaust gas-flow cross-sectional area of the E.G.R. passage at the first point determined by the first E.G.R. control valve in its partly open position to the exhaust gas-flow cross-sectional area of the E.G.R. passage at the first point determined by the first E.G.R. control valve in its fully open position is smaller than an opening area ratio of the intake pipe, that is the ratio of the intake air-flow cross-sectional area of the intake pipe determined by the throttle valve in its partly open position to the intake air-flow cross-sectional area of the intake pipe determined by the throttle valve in its fully open position and such that, at a throttle wide-open engine operating condition, the exhaust gas-flow cross-sectional area ratio is substantially equal to the intake air-flow cross-sectional area ratio.

The above and other objects, features and advantages of the present invention will become more apparent from the following description with reference to the accompanying drawings.

DESCRIPTION OF PREFERRED EMBODIMENTS

Figure 1:
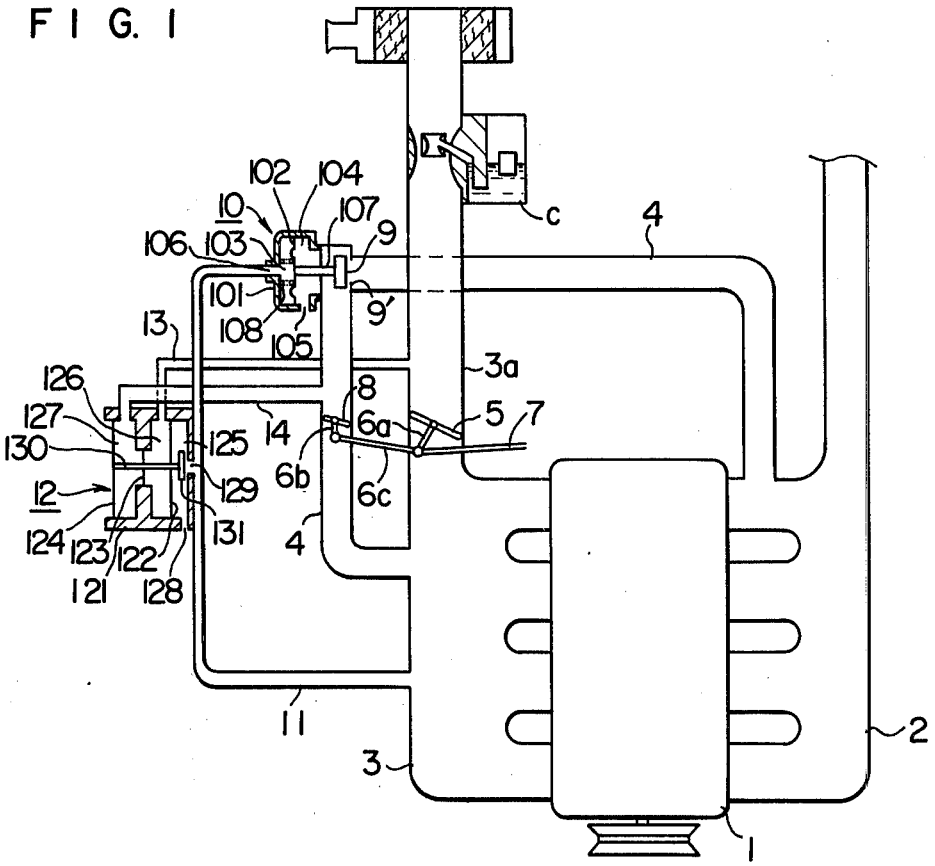
FIG. 1 diagrammatically illustrates a first embodiment of the E.G.R. system according to the present invention.

Referring now to FIG. 1, an internal combustion engine 1 includes an exhaust manifold 2, an intake manifold 3 and an E.G.R. passage 4 for the recirculation of engine exhaust gases from the exhaust manifold 2 back into the intake manifold 3. A throttle valve 5 is provided in an intake pipe 3*a* upstream of the intake manifold 3 and has a first lever 6*a* which is rigidly secured to the throttle valve 5 and operatively connected to a link rod 7 which in turn is connected to an accelerator (not shown) so that the throttle valve 5 is actuated by the accelerator. A first E.G.R. valve 8 is provided at a first point in the E.G.R. passage 4 to control the flow of exhaust gases therethrough at the first point and has a second lever 6*b* which is rigidly secured to the E.G.R. valve 8 and operatively connected to a second link rod 6*c* which operatively interconnects the levers 6*a* and 6*b*. The first lever 6*a* is longer than the second lever 6*b*. The throttle valve 5 and the first E.G.R. control valve 8 are both of butterfly type. The intake pipe 3*a* and the E.G.R. passage 4 are both generally cylindrical. When the throttle valve 5 and the first E.G.R. control valve 8 are in their fully closed positions shown in FIG. 1, the E.G.R. control valve 8 extends nearly perpendicular to the axis of the E.G.R. passage 4, while the throttle valve 5 extends obliquely to the axis of the intake pipe 3*a*, as will be described in more detail later.

A second E.G.R. control valve 9 is also provided in the E.G.R. passage 4 at a second point upstream of the first E.G.R. control valve 8 and actuated by an actuator 10 which is pneumatically connected by a first pressure conduit 11 to the intake manifold 3. A pressure comparator and modulator 12 is associated with the first pressure conduit 11 and pneumatically connected by second and third pressure conduits 13 and 14 to the intake pipe 3*a* upstream of the throttle valve 5 and downstream of a venturi of a carburetor c and the E.G.R. passage 4 between the first and second E.G.R. control valves 8 and 9, respectively, to compare the intake air pressure in the intake pipe 3*a* between the throttle valve 5 and the venturi (this pressure will be termed hereunder "intake air pressure upstream of throttle valve") with the exhaust gas pressure in the E.G.R. passage 4 between the first and second E.G.R. control valves 8 and 9 for thereby modulating the intake manifold vacuum to be fed into the valve actuator 10.

The valve actuator 10 comprises a generally cylindrical housing 101. A diaphragm 102 extends in the housing 101 to divide the interior thereof into two chambers 103 and 104. The chamber 104 is provided with an air vent hole 105 through which atmospheric air is introduced into the chamber 104. The other chamber 103 has a vacuum inlet port 106 connected to the pressure conduit 11 so that the intake manifold vacuum is applied to the diaphragm 102 to displace the same in the leftward direction as viewed in FIG. 1 against a compression coil spring 108 disposed in the chamber 103 between the diaphragm 102 and the housing 101 around the vacuum inlet port 106. The diaphragm 102 is secured to one end of a valve stem 107 extending through the chamber 104 and slidably extending into the E.G.R. passage 4 through the peripheral wall thereof. The other end of the valve stem 107 is secured to the second E.G.R. control valve 9, which is adapted to cooperate with a valve seat 9′ formed in the E.G.R. passage 4 for controlling the opening area thereof.

The pressure modulator 12 comprises a generally cylindrical housing 121. First to third diaphragms 122, 123 and 124 extend across the interior of the housing 121 in mutually spaced parallel relationship and transversely of the axis of the housing to cooperate with each other and with the housing to define three chambers 125, 126 and 127. First chamber 125, which is nearest to the pressure conduit 11, is communicated with the atmosphere through an atmospheric air inlet 128 formed in the peripheral wall of the housing 121. The first chamber 125 is also communicated with the pressure conduit 11 through a communication opening 129 positioned substantially coaxially with the housing 121. The second chamber 126 is communicated with the intake pipe 3*a* between the throttle valve 5 and the carburetor venturi through the pressure conduit 13. The third chamber 127 is communicated with the E.G.R. passage 4 between the first and second E.G.R. control valves 8 and 9 through the pressure conduit 14. A valve stem 130 extends axially in the housing 121 and has one end secured to the third diaphragm 124 and extends through and is secured to the second and first diaphragms 123 and 122. The other end of the valve stem 130 extends from the first diaphragm 122 toward the communication opening 129 and secured to a valve head 131 having a valve face disposed in opposite relationship to the communication opening 121. The first and third diaphragms 122 and 124 have substantially equal pressure receiving areas which are larger than that of the second diaphragm 123.

In operation, a part of the engine exhaust gases is recirculated from the exhaust manifold 2 through the E.G.R. passage 4 back into the intake manifold 3. The exhaust gas pressure in the E.G.R. passage 4 between the first and second E.G.R. control valves 8 and 9 is maintained substantially equal to the intake air pressure upstream of the throttle valve 5 in the manner to be discussed hereunder. The intake air pressure upstream of the throttle valve 5 is introduced through the pressure conduit 13 into the second chamber 126 of the pressure comparator and modulator 12 and acts on the first and second diaphragms 122 and 123. The exhaust gas pressure in the E.G.R. passage between the first and second E.G.R. control valves 8 and 9 (this exhaust gas pressure will be termed hereunder "E.G.R. pressure between E.G.R. control valves") is introduced through the pressure conduit 14 into the third chamber 127 and acts on the second and third diaphragms 123 and 124. It will be recalled that the first and third diaphragms 122 and 124 have substantially equal pressure receiving areas, as discussed previously. Thus, when the E.G.R. pressure between the E.G.R. control valves 8 and 9 is higher than the intake air pressure upstream of the throttle valve 5, the three diaphragms 122–124, the valve stem 130 secured thereto and the valve head 131 secured thereto are moved leftwards as viewed in FIG. 1 with the result that the introduction of the atmospheric air from the first chamber 125 through the communication opening 129 into the pressure conduit 11 is increased. This decreases the intake manifold vacuum being fed through the pressure conduit 11 into the chamber 103 of the valve actuator 10, so that the spring 108 moves the diaphragm 102 and the valve stem 107 secured thereto and the second E.G.R. control valve 9 in the rightward direction as viewed in FIG. 1. This movement of the second E.G.R. control valve 9 decreases the flow of the recirculated exhaust gases through a variable valve opening defined between the E.G.R. control valve 9 and the associated valve seat 9' provided in the E.G.R. passage 4. Thus, the increase in the E.G.R. pressure between the E.G.R. control valves 8 and 9 results in the movement of the second E.G.R. control valve 9 towards its closed position with resultant decrease in E.G.R. pressure between the E.G.R. control valves 8 and 9.

On the other hand, when the E.G.R. pressure between the E.G.R. control valves 8 and 9 is lower than the intake air pressure upstream of the throttle valve 5, the first to third diaphragms 122–124, the valve stem 130 and valve head 131 of the pressure comparator and modulator 12 are moved rightwards as viewed in FIG. 1 to reduce the flow of the atmospheric air from the first chamber 125 through the communication opening 129 into the pressure conduit 11 with the resultant increase in the intake manifold vacuum acting on the diaphragm 102 of the valve actuator 10. Thus, the increased intake manifold vacuum moves the diaphragm 102 and the second E.G.R. control valve 9 leftwards against the spring 108, with resultant increase in the flow of the recirculated exhaust gases through the variable valve opening between the second E.G.R. control valve 9 and the valve seat 9'.

The above-described operations are repeated to keep the E.G.R. pressure between the E.G.R. control valves 8 and 9 substantially equal to the pressure upstream of the throttle valve 5.

The amount of air sucked into the engine 1 is dependent on the position of the throttle valve 5 in the intake pipe 3a and on the pressure difference across the throttle valve 5, i.e., the difference between the pressure upstream of the throttle valve 5 and the pressure downstream of the throttle valve. The amount of the engine exhaust gases recirculated into the intake manifold 3 is likewise dependent on the position of the first E.G.R. valve 8 in the E.G.R. passage 4 and on the pressure difference across the E.G.R. control valve 8, i.e., on the difference between the intake manifold vacuum and the E.G.R. pressure between the first and second E.G.R. control valves 8 and 9. Because the E.G.R. pressure between the E.G.R. control valves is maintained equal to the intake air pressure upstream of the throttle valve 5, as described previously, the amount of the exhaust gases recirculated into the engine 1 is proportional to the amount of the engine intake air provided that the exhaust gas-flow cross-sectional area ratio is equal to the intake air-flow cross-sectional area ratio. Accordingly, the described arrangement of the throttle valve 5 and the first E.G.R. control valve 8 eliminates the prior art disadvantages that the exhaust gas recirculation is unduely increased at a light load engine operating condition, i.e., when the intake vacuum is increased, to disadvantageously cause surging and misfires and that the exhaust gas recirculation is unduely decreased at a heavy load engine operating condition, i.e., when the intake vacuum is decreased, to disadvantageously decrease the function of the E.G.R. system to reduce the $NO_x$ emission.

By the way, it is called "external E.G.R." to recirculate engine exhaust gases from the exhaust system of an engine back into the intake system thereof as described above. On the other hand, combustion gases produced in a combustion chamber of the engine on a combustion stroke cannot completely be discharged therefrom. A part of the combustion gases thus resides in the combustion chamber at the end of exhaust stroke and therefore at the beginning of the intake stroke. It has been found that the residual gases are also effective to reduce the $NO_x$ emission. Thus, to retain a part of combustion gases in the combustion chamber is called "internal E.G.R.". Thus, the total amount of exhaust gases obtained by the external and internal E.G.R. must be taken into consideration.

Figure 2:
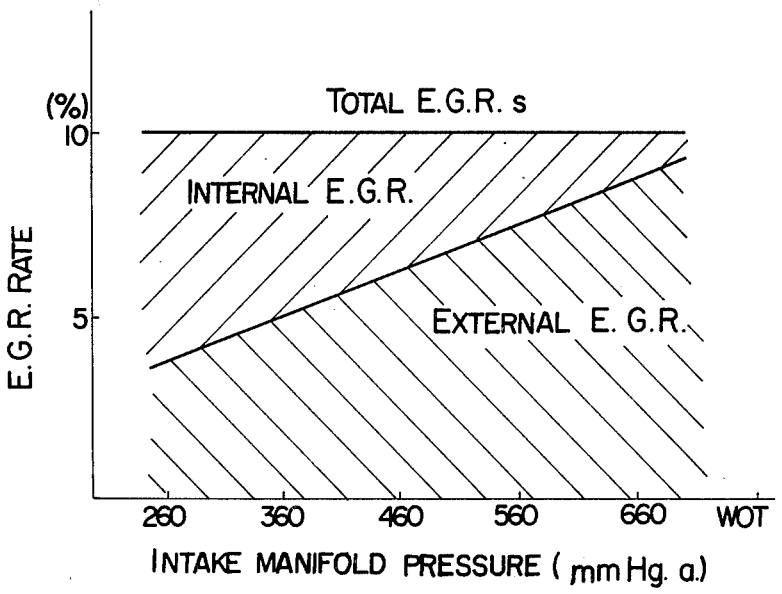
FIG. 2 graphically illustrates the variations of external and internal exhaust gas recirculations relative to intake manifold pressure.

In order to most efficiently reduce the $NO_x$ emission, it is necessary to keep constant an E.G.R. rate, that is a rate of the total amount of exhaust gases fed into combustion chamber (i.e., the amount of external E.G.R. plus the amount of internal E.G.R.) to the amount of engine intake air. As will be seen in the graph in FIG. 2, however, it has been found that a rate of internal E.G.R. (a rate of the amount of the residual combustion gases to the amount of engine intake air) is decreased as the absolute pressure in the intake manifold is increased (load on the engine is increased). In order to keep constant the E.G.R. rate of the total amount of internal and external E.G.R.s, therefore, it is required to increase a rate of the external E.G.R. (a rate of the amount of the external E.G.R. to the amount of engine intake air) as absolute pressure in the intake manifold is increased.

Figure 3:
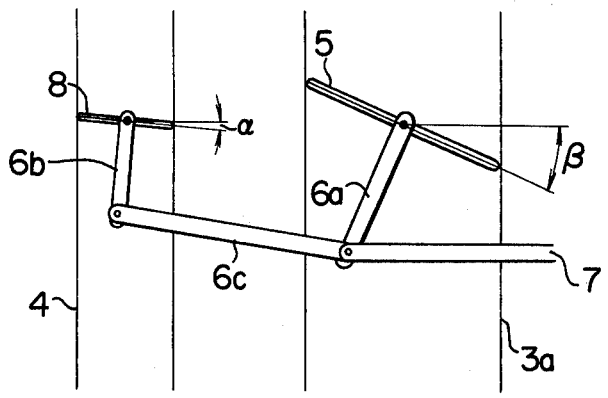
FIG. 3 is an enlarged schematic illustration of important parts of the first embodiment of the invention shown in FIG. 1.
Figure 4:
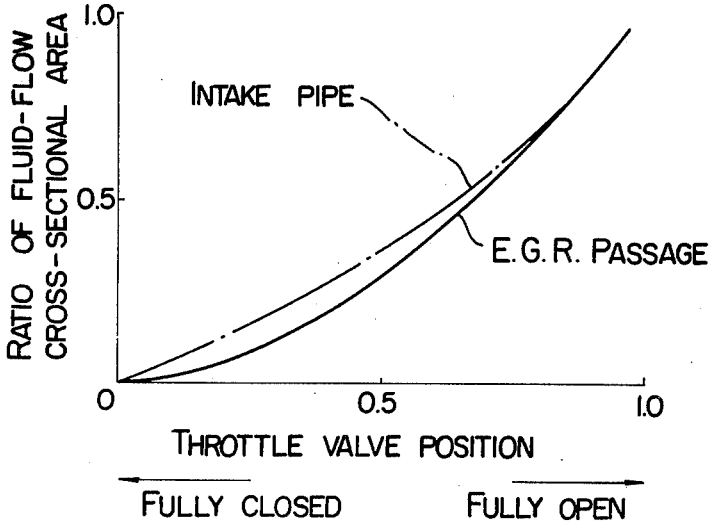
FIG. 4 graphically illustrates the operational characteristic of the first embodiment of the invention.

With the described embodiment of the invention, the second lever 6b secured to the first E.G.R. control valve 8 is shorter than the first lever 6a secured to the throttle valve 5, as described previously and as best seen in FIG. 3. The levers 6a and 6b are operatively connected by the link rod 6c. In addition, the components are arranged such that the first E.G.R. control valve 8 in its fully closed position forms with a plane perpendicular to the axis of the E.G.R. passage 4 an angle $\alpha$ which is smaller than an angle $\beta$ formed by a plane perpendicular to the axis of the intake pipe 3a and the throttle valve 5 in its fully closed position. As seen from FIG. 4, therefore, at a light load or throttle part-open engine operating condition, the opening area ratio of the E.G.R. passage (the ratio of the exhaust gas-flow cross-sectional area of the E.G.R. passage 4 determined by the first E.G.R. control valve 8 when in its partly open position to the exhaust gas-flow cross-sectional area of the E.G.R. passage 4 determined by the E.G.R. control valve 8 when in its fully open position) is smaller than the opening area ratio of the intake pipe (the ratio of the intake air-flow-cross-sectional area of the intake pipe 3*a* determined by the throttle valve 5 when in its partly open position to the intake air-flow cross-sectional area of the intake pipe 3*a* determined by the throttle valve when in its fully open position) even though the E.G.R. passage 4 is cylindrical. This will means that the exhaust gas recirculation by the external E.G.R. is at a smaller rate relative to the engine intake air flow at a light or partial load engine operating condition (throttle part-open engine operating condition), whereas the exhaust gas recirculation by the external E.G.R. is at a usual rate at a heavy load engine operating condition (throttle wide-open or full-open engine operating condition). In other words, to make the E.G.R. rate of the total E.G.R.s constant, exhaust gas recirculation by the external E.G.R. is controlled in accordance with the engine intake air flow as well as with the load on the engine. It will, therefore, be appreciated that, at a light load engine operating condition wherein a larger amount of combustion gases relative to the amount of intake air remains in combustion chamber, that is the E.G.R. rate of the internal E.G.R. is higher, the E.G.R. system described is advantageously operative to control the exhaust gas recirculation such that a smaller amount of exhaust gases relative to the amount of intake air is recirculated than in the case where the exhaust gas recirculation is controlled simply so as to be proportional to the engine intake air flow, whereby the E.G.R. system described eliminates the disadvantageous problems of the prior art and advantageously reduces the emission of $NO_x$.

As described above, the use of the intake manifold vacuum to actuate the valve actuator 10 is advantageous in that the manifold vacuum provides pressure signals of large magnitude. Thus, when the E.G.R. pressure between the E.G.R. control valves 8 and 9 is varied, the second E.G.R. control valve 9 can be easily and rapidly actuated to make the E.G.R. pressure between the E.G.R. control valves equal to the pressure upstream of the throttle valve.

The second E.G.R. control valve 9 is not limited to the described and illustrated type and may alternatively be of a butterfly type.

Figure 5:
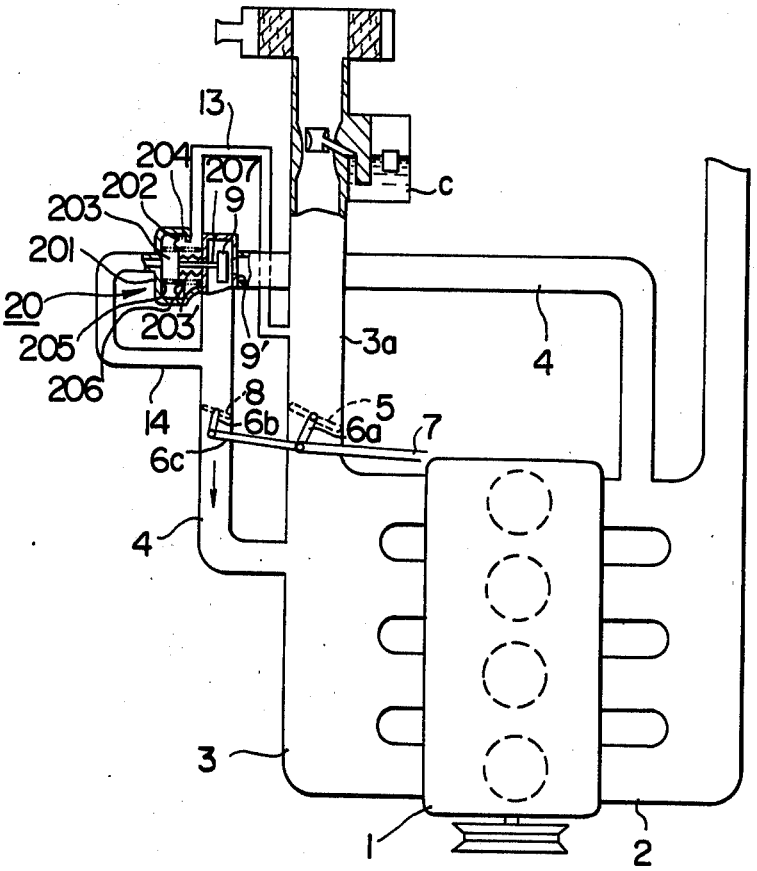
FIG. 5 is a view similar to FIG. 1 but illustrates a second embodiment of the invention.

FIG. 5 illustrates the second embodiment of the invention. Parts of the embodiment similar to those of the first embodiment are designated by similar reference numerals. The difference only will be discussed hereunder. The second embodiment is not provided with such a pressure comparator and modulator as is employed in the first embodiment and, instead, has a valve actuator 20 which is operative to compare the intake air pressure upsteam of the throttle valve 5 with the E.G.R. pressure between the E.G.R. control valves 8 and 9 to actuate the second E.G.R. control valve 9 for the control of the E.G.R. pressure between the first and second E.G.R. control valves.

The valve actuator 20 comprises a housing 201. A diaphragm 202 extends across the interior of the housing 201 to cooperate therewith to define first and second chambers 203 and 204 in which coil springs 205 and 206 of the same spring force are disposed between the housing end walls and the diaphragm 202, respectively. The second E.G.R. control valve 9 is secured to the diaphragm 202 by means of a valve stem 207 extending through the chamber 204 and surrounded by the coil spring 206. The chamber 204 is sealed from the E.G.R. passage 4 by a bellows member 203' extending between the diaphragm 202 and the housing end wall through which the valve stem 207 extends slidably. The chamber 203 is communicated by the pressure conduit 14 with the E.G.R. passage 4 between the first and second E.G.R. control valves 8 and 9, while the other chamber 204 is communicated by the pressure conduit 13 with the intake pipe 3*a* between the throttle valve 5 and the carburetor venturi.

With the above described arrangement of the valve actuator 20, if the E.G.R. pressure between the first and second E.G.R. control valves 8 and 9 is higher than the intake air pressure upstream of the throttle valve 5, the diaphragm 202, the valve stem 207 and the second E.G.R. control valve 9 are moved rightwards as viewed in FIG. 5 to reduce the flow of the recirculated exhaust gases past the second E.G.R. control valve 9 to thereby lower the E.G.R. pressure between the first and second E.G.R. control valves 8 and 9. On the other hand, if the E.G.R. pressure between the E.G.R. control valves 8 and 9 is lower than the intake air pressure upstream of the throttle valve 5, the diaphragm 202, the valve stem 207 and the second E.G.R. control valve 9 are moved leftwards as viewed in FIG. 5 to increase the flow of recirculated exhaust gases past the second E.G.R. control valve 9 to thereby raise the E.G.R. pressure between the first and second E.G.R. control valves 8 and 9.

As such, the valve actuator 20 is operative to maintain the E.G.R. pressure between the first and second E.G.R. control valves 8 and 9 at a pressure substantially equal to the pressure upstream of the throttle valve 5, as in the first embodiment.

Figure 6:
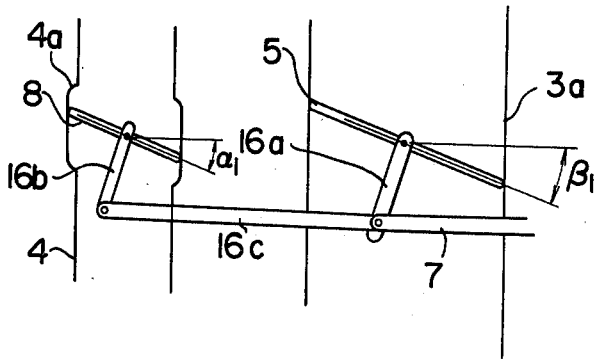
FIG. 6 is a schematic illustration of important parts of a third embodiment of the invention.

FIG. 6 illustrates the third embodiment of the invention. In this embodiment, the second E.G.R. control valve 8 has secured thereto a lever 16*b* having the same length as that of a lever 16*a* secured to the throttle valve 5. The levers 16*a* and 16*b* are operatively connected by a link rod 16*c*. The second E.G.R. control valve 8 formes with a plane perpendicular to the axis of the E.G.R. passage 4 an angle $\alpha_1$ which is always equal to an angle $\beta_1$ formed between the throttle valve 5 and a plane perpendicular to the axis of the intake pipe 3*a*. The part of the E.G.R. passage 4 surrounding the second E.G.R. control valve 8 is outwardly deformed or bulged as at 4*a*. When the second E.G.R. control valve 8 is in a partially opened position, the exhaust gas-flow cross-sectional area of the E.G.R. passage 4 is determined by the outwardly bulged portion 4*a* and the second E.G.R. control valve 8. Thus, the operating characteristic of the embodiment is similar to that shown in FIG. 4. Thus, the embodiment provides functional advantages similar to those of the first embodiment previously described.

What is claimed is:

1. An exhaust gas recirculation system for an internal combustion engine comprising: an E.G.R. passage for recirculating engine exhaust gases from an exhaust system of an engine back into an intake system thereof downstream of a throttle valve of said engine, a first E.G.R. control valve disposed at a first point in said E.G.R. passage and operatively associated with said throttle valve to control the exhaust gas-flow cross-sectional area of said E.G.R. passage at said first point, a second E.G.R. control valve disposed at a second point in said E.G.R. passage upstream of said first E.G.R. control valve to control the exhaust gas-flow cross-sectional area of said E.G.R. passage at said second point, means for controlling said second E.G.R. control valve so as to make the exhaust gas pressure in said E.G.R. passage between said first and second E.G.R. control valves substantially equal to the air pressure in said intake system of said engine upstream of said throttle valve.

2. An exhaust gas recirculation system according to claim 1, wherein said first E.G.R. control valve and said E.G.R. passage adjacent to said first point are arranged such that, when said throttle valve is in its partly open position, the ratio of the exhaust gas-flow cross-sectional area of said E.G.R. passage at said first point determined by said first E.G.R. control valve in its partly open position to the exhaust gas-flow cross-sectional area of said E.G.R. passage at said first point determined by said first E.G.R. control valve in its fully open position is smaller than the ratio of the intake air-flow cross-sectional area of said intake pipe determined by said throttle valve in its partly open position to the intake air-flow cross-sectional area of said intake pipe determined by said throttle valve in its fully open position and duch that, at a throttle wide-open engine operating condition, said exhaust gas-flow cross-sectional area ratio is substantially equal to said intake air-flow cross-sectional area ratio.

3. An exhaust gas recirculation system according to claim 1, wherein said controlling means comprises means operative to compare the intake air pressure upstream of said throttle valve with the exhaust gas pressure between said first and second E.G.R. control valves and actuate said second E.G.R. control valve for the control of the flow of the exhaust gas through said E.G.R. passage at said second point.

4. An exhaust gas recirculation system according to claim 2, wherein said controlling means comprises means operative to compare the intake air pressure upstream of said throttle valve with the exhaust gas pressure between said first and second E.G.R. control valves and actuate said second E.G.R. control valve for the control of the flow of the exhaust gas through said E.G.R. passage at said second point.

5. An exhaust gas recirculation system according to claim 1, wherein said controlling means comprises a valve actuator operable by pressure signals from a pressure signal source to actuate said second E.G.R. control valve for the control of the flow of the exhaust gas through said E.G.R. passage at said second point, and means communicated with said pressure signal source and operative to compare the intake air pressure upstream of said throttle valve with the exhaust gas pressure between said first and second E.G.R. control valves to modify pressure signals from said pressure signal source to said valve actuator in accordance with the result of the comparison.

6. An exhaust gas recirculation system according to claim 2, wherein said controlling means comprise a valve actuator operable by pressure signals from a pressure signal source to actuate said second E.G.R. control valve for the control of the flow of the exhaust gas through said E.G.R. passage at said second point, and means communicated with said pressure signal source and operative to compare the intake air pressure upstream of said throttle valve with the exhaust gas pressure between said first and second E.G.R. control valves to modify pressure signals from said pressure signal source to said valve actuator in accordance with the result of the comparison.

7. An exhaust gas recirculation system according to claim 5, wherein said pressure signal source is the intake system of said engine downstream of said throttle valve.

8. An exhaust gas recirculation system according to claim 6, wherein said pressure source is the intake system of said engine downstream of said throttle valve.

9. An exhaust gas recirculation system according of claim 2, wherein said throttle valve and said first E.G.R. control valve are both of butterfly type and rigidly secured respectively to first and second levers operatively connected together by a link member, said second lever is shorter than said first lever, and said first E.G.R. control valve forms with a plane perpendicular to the axis of said E.G.R. passage an angle which is smaller than an angle formed between said throttle valve and the plane perpendicular to axis of said intake pipe.

10. An exhaust gas recirculation system according to claim 2, wherein said intake pipe adjacent to said throttle valve is substantially cylindrical and said E.G.R. passage includes an outwardly bulged portion surrounding said first E.G.R. control valve, and wherein said throttle valve and said first E.G.R. control valve are both of butterfly type and rigidly secured respectively to first and second levers which have substantially the same length and are operatively connected together by a link member, said first E.G.R. control valve forms with a plane perpendicular to the axis of said E.G.R. passage an angle which is substantially equal to an angle formed between said throttle valve and a plane perpendicular to the axis of said intake pipe.

* * * * *